US008282176B1

(12) United States Patent
Chen et al.

(10) Patent No.: US 8,282,176 B1
(45) Date of Patent: Oct. 9, 2012

(54) SLIDE ASSEMBLY HAVING LOCKING MECHANISM

(75) Inventors: Ken-Ching Chen, Kaohsiung Hsien (TW); Hsueh-Lung Liu, Kaohsiung Hsien (TW); Chun-Chiang Wang, Kaohsiung Hsien (TW)

(73) Assignee: King Slide Works Co., Ltd., Kaohsiung Hsien (TW)

( * ) Notice: Subject to any disclaimer, the term of this patent is extended or adjusted under 35 U.S.C. 154(b) by 0 days.

(21) Appl. No.: 13/157,408

(22) Filed: Jun. 10, 2011

(51) Int. Cl.
*A47B 95/00* (2006.01)

(52) U.S. Cl. ..... 312/333; 312/334.46

(58) Field of Classification Search ..... 312/333, 312/334.44, 334.46–334.47, 319.1; 384/21
See application file for complete search history.

(56) References Cited

U.S. PATENT DOCUMENTS

| | | | | |
|---|---|---|---|---|
| 5,033,805 | A | 7/1991 | Hobbs | |
| 6,398,041 | B1 | 6/2002 | Abbott | |
| 6,883,884 | B2 | 4/2005 | Chen et al. | |
| 7,364,244 | B2 | 4/2008 | Sandoval | |
| 7,374,261 | B1 * | 5/2008 | Wang | 312/333 |
| 7,465,000 | B2 * | 12/2008 | Huang | 312/333 |
| 7,604,308 | B2 | 10/2009 | Tseng et al. | |
| 7,758,134 | B2 * | 7/2010 | Huang | 312/334.47 |
| 7,815,267 | B1 * | 10/2010 | Frousiakis | 312/333 |
| 7,878,606 | B2 * | 2/2011 | Chen et al. | 312/333 |
| 7,914,093 | B2 * | 3/2011 | Huang | 312/333 |
| 8,079,653 | B2 * | 12/2011 | Huang | 312/333 |
| 8,083,304 | B2 * | 12/2011 | Hu | 312/333 |
| 8,132,873 | B2 * | 3/2012 | Yang | 312/333 |
| 2004/0227438 | A1 * | 11/2004 | Tseng et al. | 312/333 |
| 2007/0001562 | A1 * | 1/2007 | Park | 312/333 |
| 2007/0182292 | A1 * | 8/2007 | Huang | 312/221 |
| 2009/0294393 | A1 | 12/2009 | Chen et al. | |
| 2010/0164340 | A1 * | 7/2010 | Juan et al. | 312/333 |

* cited by examiner

*Primary Examiner* — Hanh V Tran
(74) *Attorney, Agent, or Firm* — Rosenberg, Klein & Lee

(57) ABSTRACT

A locking mechanism of a slide assembly is connected between a first rail and a second rail, and includes a top, a locking member, a release member and a resilient member. The stop is connected to the first rail and the locking member is pivotably connected to the second rail. The release member has a window to accommodate the locking member. The window includes an inclined surface which is located corresponding to the locking member. The resilient member contacts between the locking member and the inside of the window to keep the locking member to be located corresponding to the stop. When the second rail is retracted relative to the first rail, the locking member is engaged with the stop. When the operation portion of the release member is pulled outward, the locking member is guided by the inclined surface and pivoted toward another direction to disengage from the stop.

7 Claims, 6 Drawing Sheets

SLIDE ASSEMBLY HAVING LOCKING MECHANISM

FIELD OF THE INVENTION

The present invention relates to a slide assembly having a locking mechanism, and more particularly, to an automatically locked and easily released locking mechanism when the rails of the slide assembly are retracted.

BACKGROUND OF THE INVENTION

A conventional locking mechanism for a slide assembly at a retracted status is disclosed in U.S. Pat. No. 5,033,805 and includes a locking member to restrict the rails of the drawer and the mediate rail, the mediate rail is connected with the cabinet rail. Another disclosure is disclosed in U.S. Pat. No. 6,398,041 B1 which includes a drawer slidably connected to the rails which are connected to columns. The locking mechanism is fixed to the columns. U.S. Pat. No. 6,883,884 B2 and 7,604,308 B2 are filed by the applicant of this application and include a latch which is located at the front end of the inner rail and when the rails are retracted, the latch is engaged with the fixed portion of the rails. U.S. Publication No. 2009/0294393 A1 owned by the applicant of this application discloses a quick activation device which allows the rails to be quickly locked or unlocked relative to the rack. The rails are automatically locked when the rails are retracted.

U.S. Pat. No. 7,364,244 B2 to Sandoval discloses a "User-controllable latching carrier rail system" and includes a movable latching member 212A in FIG. 3B which has a distal portion 310A fixed to a slide rail 302A. An intermediate portion 310B is located at an angle relative to the distal portion. A proximal portion 310C extends from the intermediate portion, and a handle 204 extends from the proximal portion. The proximal portion has a protrusion 308 so that the user directly operates the handle to deform the intermediate portion and the proximal portion relative to the slide rails, the protrusion can disengage from the locked status.

Obviously, there are many different arrangements for the locking devices of rails, and the applicant hereby invents a locking mechanism which is easily operated and different from the existed ones.

SUMMARY OF THE INVENTION

The present invention relates to a slide assembly having a locking mechanism and comprises a first rail and a second rail which is longitudinally movable relative to the first rail. The locking mechanism comprises a stop, a locking member, a release member and a resilient member. The stop is connected to the first rail and the locking member is pivotably connected to the second rail. The release member is longitudinally and movably connected to the second rail. The release member has an operation portion and a window which accommodates the locking member. An inside of the window has an inclined surface located corresponding to the locking member. The resilient member contacts between the locking member and an inner edge of the window so as to keep the locking member to be located corresponding to the stop. When the second rail is retracted relative to the first rail, the locking member is engaged with the stop and the resilient member contacts the locking member. When the operation portion of the release member is pulled outward, the locking member is guided by the inclined surface of the window and is pivoted toward another direction so as to disengage the locking member from the stop.

Preferably, the slide assembly further comprises a third rail which is slidably connected between the first and second rails.

Preferably, the resilient member is a flexible leg which extends from the release member, or the resilient member is a flexible leg connected to the locking member.

Preferably, the slide assembly further comprises a bracket which is connected to the first rail.

Preferably, the stop is a plate extending from the bracket.

Preferably, the bracket includes an engaging member and the stop extends from the engaging member.

The primary object of the present invention is to provide a slide assembly having a locking mechanism such that the rails are automatically locked when in a retracted position, and the locking mechanism is released when the rails are pulled outward.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
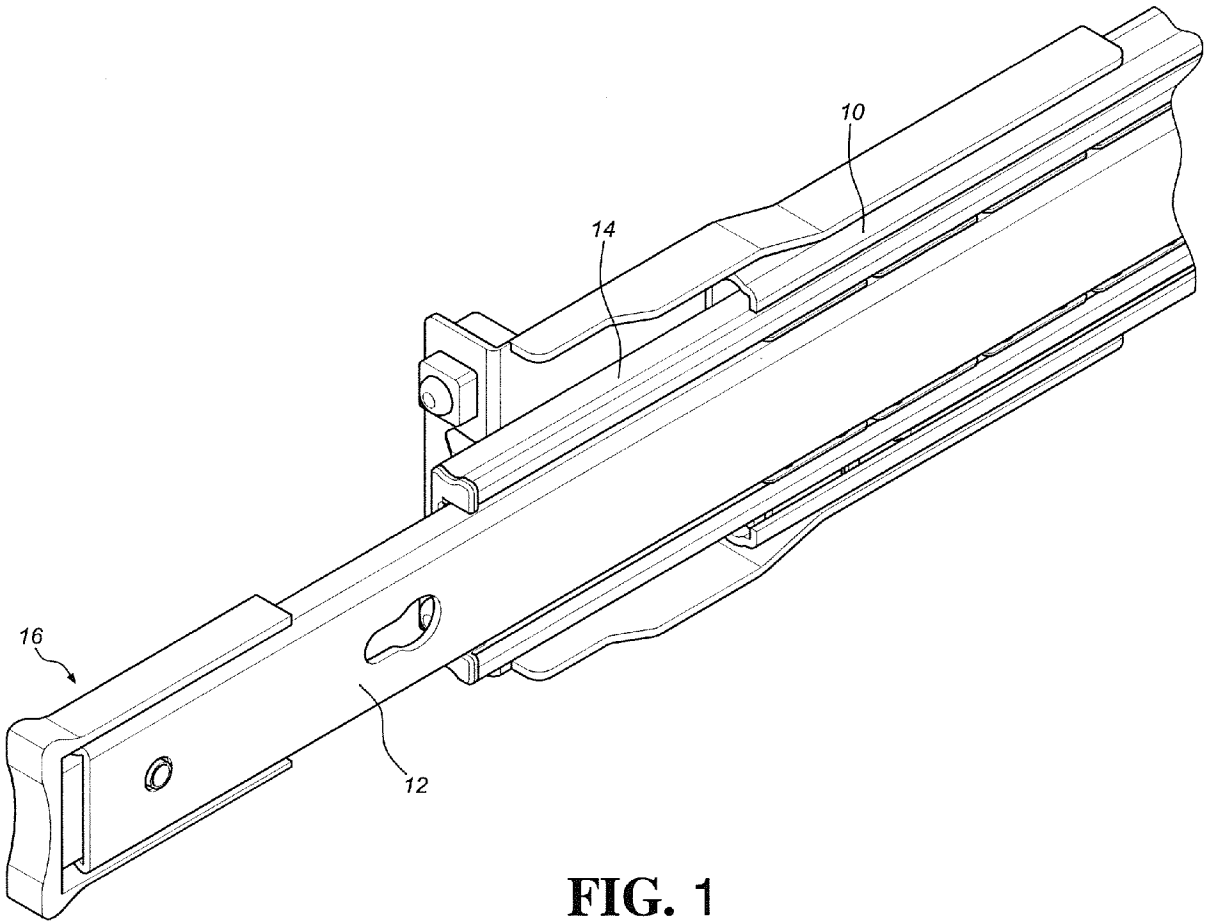
FIG. 1 is a perspective view to show the slide assembly having the locking mechanism of the present invention.
Figure 2:
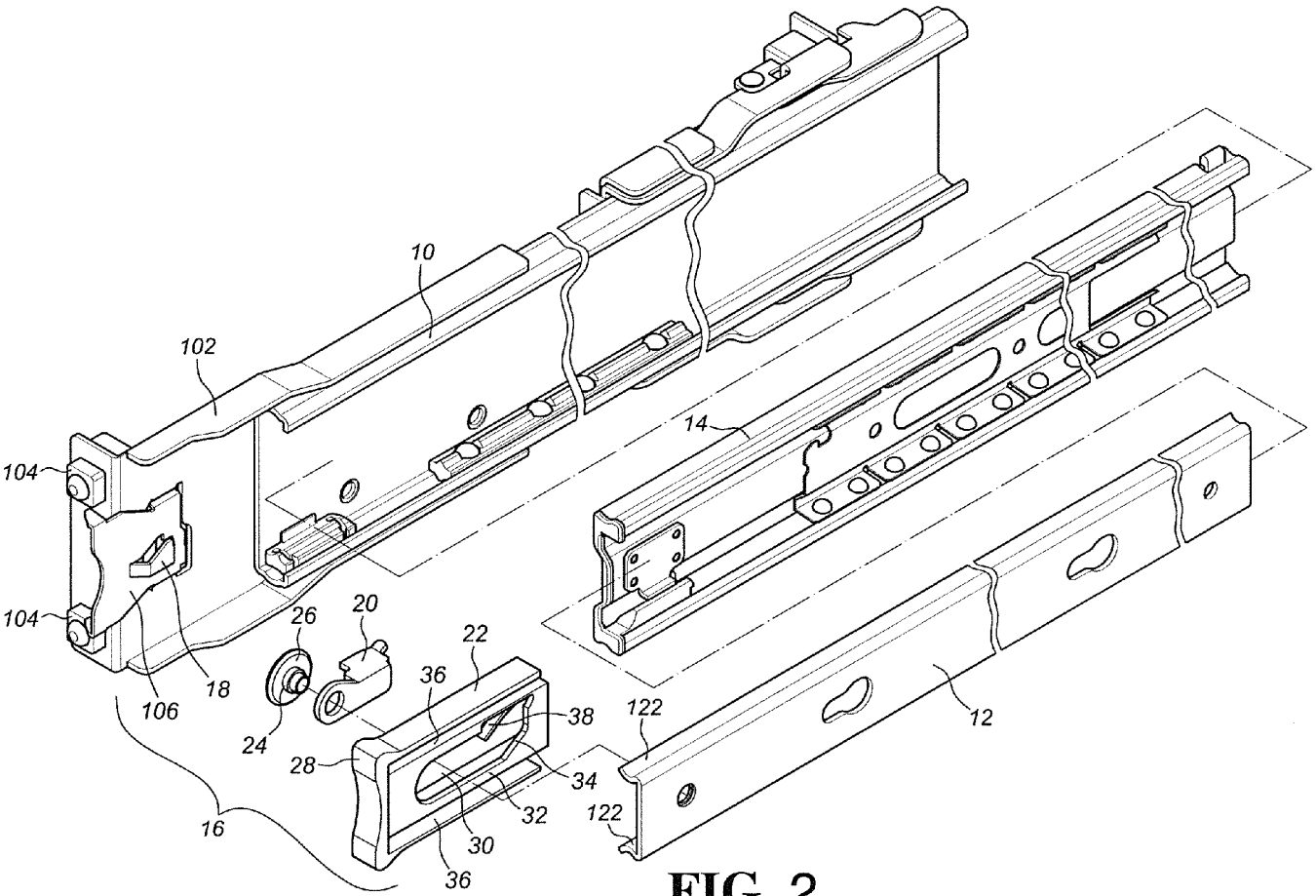
FIG. 2 is an exploded view to show the slide assembly having the locking mechanism of the present invention.

Referring to FIG. 1, the slide assembly of the present invention comprises a first rail 10, a second rail 12, a third rail 14 and a locking mechanism 16 which is disclosed in FIG. 2. The first rail 10 is the outer rail, the second rail 12 is the inner rail, and the third rail 14 is the mediate rail. The second rail 12 is movably connected to the third rail 14 which is slidably connected to the first rail 10. Therefore, the second rail 12 is longitudinally movable relative to the first rail 10. The third rail 14 is slidably connected between the first and second rails 10, 12. By the third rail 14, the second rail 12 is extended to a further range relative to the first rail 10. The locking mechanism 16 is used to lock the second rail 12 and maintained at its position relative to the first rail 10 when the second rail 12 is retracted relative to the first rail 10.

FIG. 2 shows that a bracket 102 is connected to the first rail 10. The bracket 102 comprises multiple installation members 104 and an engaging member 106. The installation members 104 are engaged with positioning holes in a column of a rack which is not shown, and the engaging member 106 is engaged with the column of the rack to install the slide assembly to the rack. When the pair of the rails are installed on the two horizontal sides of the rack, a chassis (not shown) is slidably connected to the rack by the rails. This is only an embodiment in the invention.

It is noted that the bracket 102 is connected to the first rail 10 so as to extend the distance of the first rail 10. Therefore, the bracket 102 is deemed as a part of the first rail 10 and the second rail 12 comprises two flanges 122.

In a preferred embodiment, the locking mechanism 16 comprises a stop 18, a locking member 20 and a release member 22.

Figure 3:
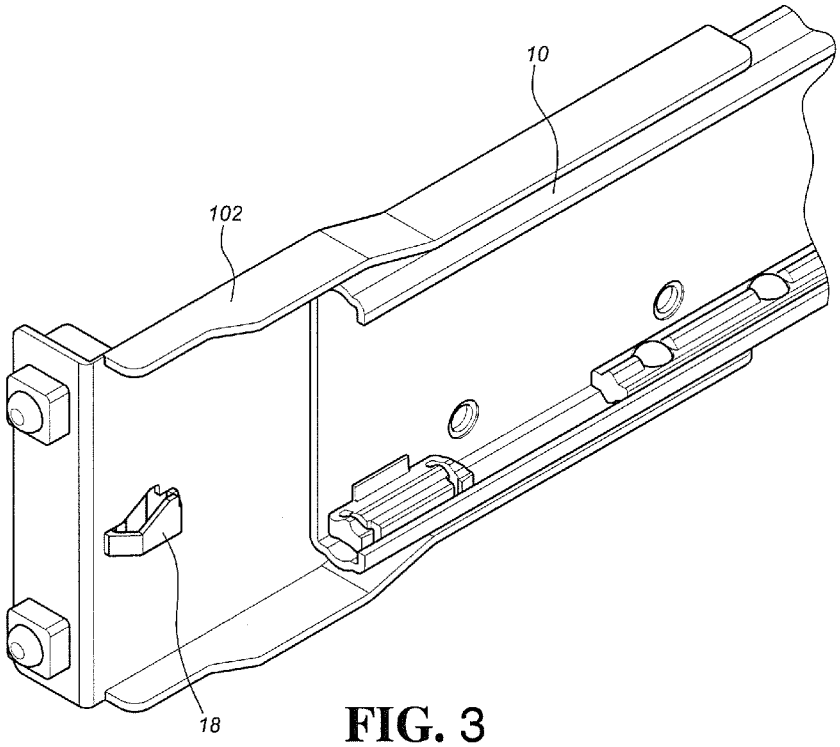
FIG. 3 shows another embodiment of the stop of the locking mechanism of the present invention.

The stop 18 is connected to the first rail 10, preferably, connected to an end of the first rail 10. In this embodiment, the stop 18 is a plate which is made by way of pressing and extends from the engaging member 106. Alternatively, as shown in FIG. 3, the stop 18 is a part of the bracket 102 of the first rail 10 and is made by way of pressing and extends from the bracket 102.

The locking member 20 is pivotably connected to the second rail 12 by a pivot 24 which has a head 26.

Figure 4:
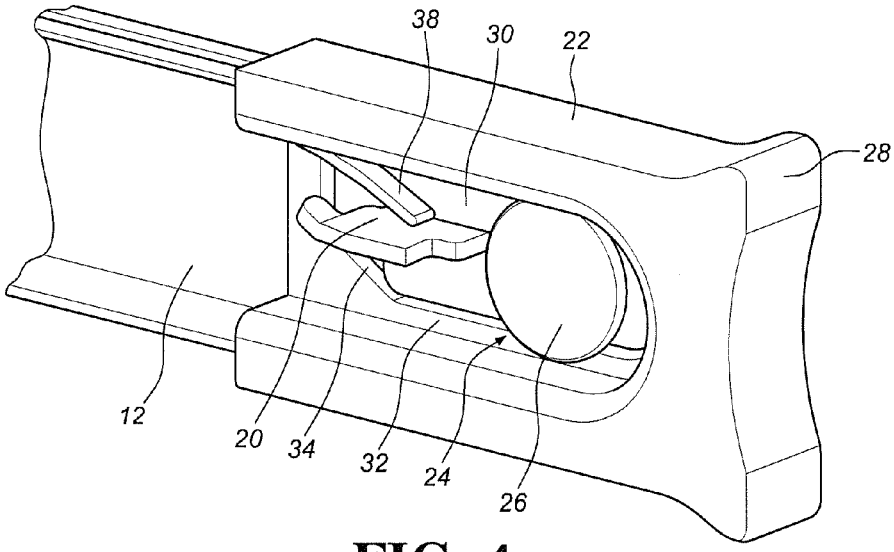
FIG. 4 shows that the resilient member is a flexible leg which extends from the release member.

The release member 22 is longitudinally and movably connected to the second rail 12, as shown in FIG. 4. The release member 22 has an operation portion 28 and a window 30 which accommodates the locking member 20. A wall 32 is located around the window 30 and connected to the locking member 20. The wall 32 has an inclined surface 34 located corresponding to the locking member 20. By contacting the head 26 of the pivot 24 against the wall 32, the release member 22 is matched with the second rail 12. As shown in FIG. 2, the release member 22 includes two slots 36 in two sides thereof and the flanges 122 of the second rail 12 are located in the two slots 36.

Figure 5:
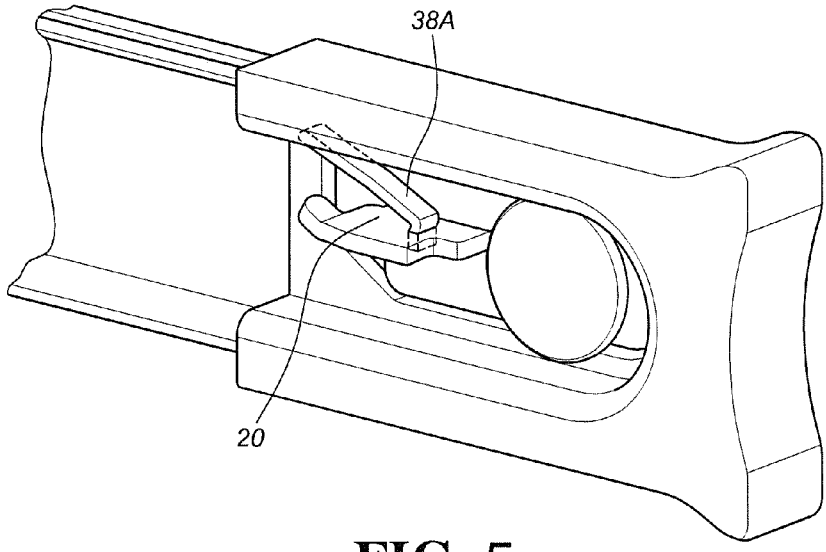
FIG. 5 shows that the resilient member is a flexible leg connected to the locking member.

The locking mechanism 16 further has a resilient member contacting between the locking member 20 and an inner edge of the window 30 so as to keep the locking member 20 to be located corresponding to the stop 18. As shown in FIG. 4, the resilient member is a flexible leg 38 which extends from the release member 22, or the resilient member is a flexible leg 38A which is connected to the locking member 20 as show in FIG. 5.

Figure 6:
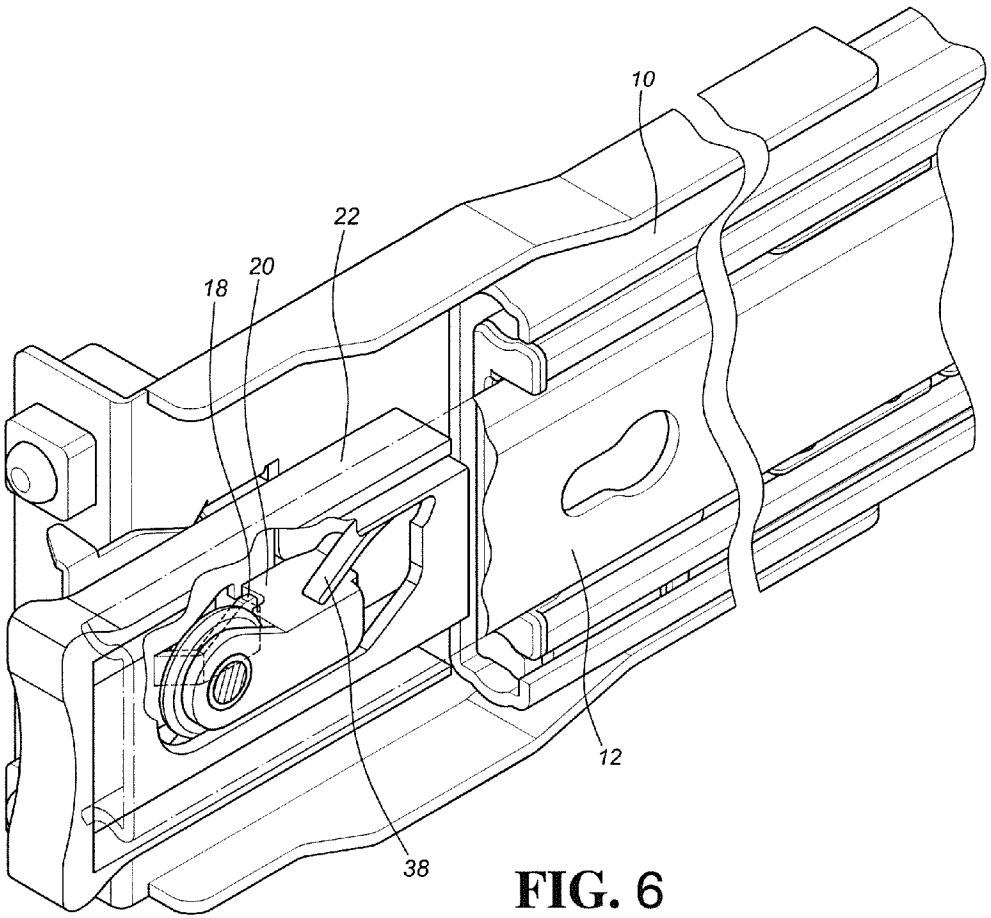
FIG. 6 shows that the slide assembly is locked by the locking mechanism of the present invention.

When the second rail 20 is retracted relative to the first rail 10, as shown in FIG. 6, the locking member 20 is engaged with the stop 18 and the resilient member applies the force to let the flexible leg 38 of the release member 22 contact the locking member 20 to keep the stable status of the engagement.

Figure 7:
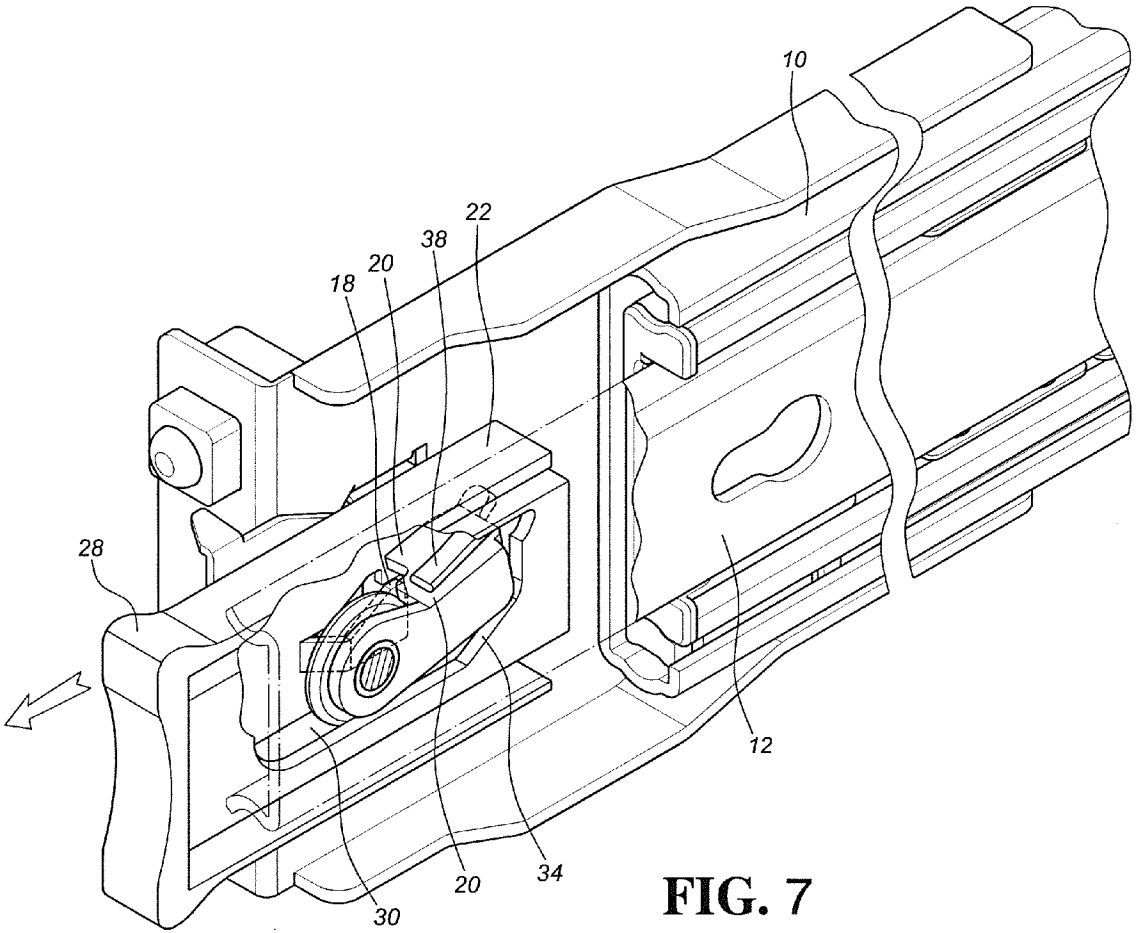
FIG. 7 shows that when the release member is pulled outward, the locking member is disengaged from the stop.

As shown in FIG. 7, when the operation portion 28 of the release member 22 is pulled outward in the direction as shown by the arrowhead, the locking member 20 is guided by the inclined surface 34 of the window 30 and pivoted toward another direction so as to disengage from the stop 18. Therefore, the second rail 12 is freely pulled out relative to the first rail 10. When the operation portion 28 of the release member 22 is released, the locking member 20 bounces back to the position located corresponding to the stop 18 by the resilient force such as the resilient force from the flexible leg 38. The second rail 12 is retracted relative to the first rail 10 and the locking member 20 is maintained to be engaged with the stop 18 as shown in FIG. 6.

While we have shown and described the embodiment in accordance with the present invention, it should be clear to those skilled in the art that further embodiments may be made without departing from the scope of the present invention.

What is claimed is:

1. A slide assembly, comprising:

a first rail;

a second rail longitudinally movable relative to the first rail;

a locking mechanism comprising a stop connected to the first rail; a locking member pivotably connected to the second rail; a release member longitudinally and movably connected to the second rail, the release member having an operation portion and a window which accommodates the locking member, an inside of the window having an inclined surface located corresponding to the locking member; and a resilient member contacting between the locking member and an inner edge of the window so as to keep the locking member to be located corresponding to the stop;

wherein, when the second rail is retracted relative to the first rail, the locking member is engaged with the stop and the resilient member contacts the locking member;

wherein, when the operation portion of the release member is pulled outward, the locking member is guided by the inclined surface of the window and pivoted toward another direction so as to disengage from the stop.

2. The slide assembly as claimed in claim 1, further comprising a third rail which is slidably connected between the first and second rails.

3. The slide assembly as claimed in claim 1, wherein the resilient member is a flexible leg which extends from the release member.

4. The slide assembly as claimed in claim 1, wherein the resilient member is a flexible leg which is connected to the locking member.

5. The slide assembly as claimed in claim 1, further comprising a bracket which is connected to the first rail.

6. The slide assembly as claimed in claim 5, wherein the stop is a plate extending from the bracket.

7. The slide assembly as claimed in claim 5, wherein the bracket includes an engaging member and the stop extends from the engaging member.

* * * * *